US010980094B1

(12) United States Patent
Chang et al.

(10) Patent No.: US 10,980,094 B1
(45) Date of Patent: Apr. 13, 2021

(54) POWER SUPPLY APPARATUS FOR STRING LIGHT

(71) Applicants: Yen-Chiu Chang, Taipei (TW); Shu-Fa Shao, New Taipei (TW)

(72) Inventors: Yen-Chiu Chang, Taipei (TW); Shu-Fa Shao, New Taipei (TW)

(73) Assignee: Yen-Chiu Chang, Taipei (TW)

( * ) Notice: Subject to any disclaimer, the term of this patent is extended or adjusted under 35 U.S.C. 154(b) by 0 days.

(21) Appl. No.: 16/920,931

(22) Filed: Jul. 6, 2020

(30) Foreign Application Priority Data

Jun. 24, 2020 (TW) ..... 10912171.4
Jun. 24, 2020 (TW) ..... 10920813.1

(51) Int. Cl.
*H05B 45/37* (2020.01)
*H05B 45/325* (2020.01)

(52) U.S. Cl.
CPC ..... *H05B 45/37* (2020.01); *H05B 45/325* (2020.01)

(58) Field of Classification Search
None
See application file for complete search history.

(56) References Cited

U.S. PATENT DOCUMENTS 9,781,781 B2 * 10/2017 Huang ..... H05B 45/00
10,165,638 B1 * 12/2018 Wang ..... H05B 45/00

* cited by examiner

*Primary Examiner* — Alexander H Taningco
*Assistant Examiner* — Pedro C Fernandez
(74) *Attorney, Agent, or Firm* — McClure, Qualey & Rodack, LLP

(57) ABSTRACT

A power supply apparatus for string light includes a power cable, a switching circuit, and a power transformer. The switching circuit is electrically connected to the two wires and configured to selectively form a voltage grading between the two wires. The power transformer includes a power transforming circuit and a control circuit. The power transforming circuit receives an external power via an input terminal, transforms the external power into a driving power, and outputs the driving power via an output terminal. The receiving end of the power cable is electrically connected to the output terminal. The control circuit is electrically connected to the power transforming circuit and the two wires. The control circuit detects a voltage grading status between the two wires, and generates a switch signal according to the voltage grading status to the power transforming circuit to modulate the driving power.

8 Claims, 14 Drawing Sheets

POWER SUPPLY APPARATUS FOR STRING LIGHT

CROSS-REFERENCES TO RELATED APPLICATIONS

This non-provisional application claims priority under 35 U.S.C. § 119(a) to Patent Application No. 109121714 and No. 109208131 filed in Taiwan, R.O.C. on Jun. 24, 2020, the entire contents of which are hereby incorporated by reference.

BACKGROUND

Technical Field

This disclosure relates to a power transformer, in particular to a power supply apparatus for a string light.

Related Art

A string light is a string-shaped illumination device having a plurality of light emitting diodes (LEDs) through serial connection, parallel connection or hybrid connection of serial/parallel connection.

The string light is usually driven by a Pulse Width Modulation (PWM) signal generated by a power transformer. By modulating the output voltage, the frequency, and the duty ration of the PWM signal, the brightness and the twinkling frequency of the LEDs of the string light are changed.

As shown in FIG. 1, in the art, the power transformer for a string light is integrated within an AC power plug to be directly inserted into a domestic AC power socket. The control circuit for the string light is also integrated into this AC power plug. For example, in U.S. Pat. No. 9,781,781B2 a control circuit and a power transforming circuit are all disposed within a casing of an AC power plug; a switch is welded and fixed on a circuit board in the AC power plug, and the free end of the switch is exposed on the casing through a hole of the casing; a sealing piece is mounted on the casing to cover the hole, so as to seal the switch. By pressing the switch, the control circuit changes the output of the power transforming circuit to output corresponding PWM signal to the loading end of the power transformer. In this power transformer integrated into the AC power plug, switches or buttons are integrated into the AC power plug; that is; the locations of the switches or the button are restricted by this AC power plug. When the user operates the switches or buttons, the operation is performed nearby the domestic AC power socket; the user might be shocked by the domestic AC power socket. Moreover, waterproof design is difficult to apply on the power transformer integrated into the AC power plug. In U.S. Pat. No. 9,781,781B2 the hole and the switch are covered by the sealing piece, when the switch is pressed the sealing piece is also pressed and rubbed, and the sealing piece is easily to be damaged. When the AC power plug is wetted, leakage of electricity occurs on the power transformer integrated into the AC power plug and the user is very possibly shocked by the leakage.

As shown in FIG. 2, another approach in the art is to dispose the control circuit and the button/switches to another casing to form an independent controller. The controller can be disposed at anywhere on the power cable. However, under this configuration, beside the power cable for transmit power; at least one additional signal wire is required to transmit control signals from the control circuit to the power transforming circuit in the AC power plug. The additional signal wire complexes the arrangement of the electric wiring.

SUMMARY

In view of the problems, one of more embodiment of this disclosure provide a power supply apparatus for a string light, which is capable to change the switch operation of the string light.

One of more embodiment of this disclosure provide a power supply apparatus for a string light, includes a power cable, a switching circuit, a power transformer. The power cable includes a receiving end and a loading end, and the power cable includes at least two wires respectively extending from the receiving end to the loading end. The switching circuit is electrically connected to the two wires and configured to selectively form a voltage grading between the two wires. The power transformer includes a power transforming circuit and a control circuit. The power transforming circuit includes an input terminal and an output terminal. The power transforming circuit receives an external power via the input terminal, transforms the external power into a driving power, and outputs the driving power via the output terminal. The receiving end of the power cable is electrically connected to the output terminal. The control circuit is electrically connected to the power transforming circuit and the two wires. The control circuit detects a voltage grading status between the two wires, and generates a switch signal according to the voltage grading status to the power transforming circuit to modulate the driving power. The driving power is a Pulse Width Modulation (PWM) signal, and the switch signal is configured to modulate a duty ration of the PWM signal.

In at least one embodiment, the power transformer further includes a casing and two metal pins, the power transforming circuit and the control circuit are disposed within the casing, and the metal pins protrude from a surface of the casing and are electrically connected to the input terminal.

In at least one embodiment, the switching circuit is a normally open switch, and a divider resistance is provided to connect the normally open switch to one of the two wires.

In at least one embodiment, the switching circuit includes an encoder, a plurality of normally open switches, a power switch IC, and a divider resistance; the plurality of normally open switches are electrically connected to the encoder and are respectively configured to be pressed to generate a corresponding selection signal, each of the plurality of normally open switches respectively corresponds to each of a plurality trigger signal combination, and each of the plurality of normally open switches is configured to trigger the encoder to generate the switching signal according to the corresponding trigger signal combination, so as to drive the power switch IC to connect the two wires via the divider resistance to form the voltage grading according to the corresponding trigger signal combination; and the control circuit includes a power management IC, a switch controller and a decoder; the switch controller is electrically connected to the power management IC and the decoder and receives an operation power from the power management IC; the decoder is electrically connected to the two wires, and the decoder is configured to analyze each of the plurality of the trigger signal combinations and transmit corresponding information to the switch controller, such that the switch controller generates a switch signal to the power transforming circuit according to the corresponding trigger signal combination to modulate the driving power.

In at least one embodiment, the control circuit further includes a remote signal receiver electrically connected to the switch controller; wherein the remote signal receiver is configured to receive a plurality of remote selection signals and transmit to the switch controller; each of the remote selection signals corresponds to a switch mode and generates a switch signal according to the voltage grading status to the power transforming circuit to modulate the driving power.

In at least one embodiment, the power transforming circuit further includes a converter arranged corresponding to the input terminal, the converter is configured to transform the external power into a direct-current power, and the power management IC is electrically connected to the converter, to change a voltage level of the direct-current power to form the driving power.

In at least one embodiment, at every sampling time point the power management IC switches a voltage of the driving power in to a sampling voltage and maintains the sampling voltage for a detecting time period, and the decoder executes at least one detection within the detecting time period to determine whether the voltage grading status occurs and analyze the corresponding trigger signal combination.

In at least one embodiment, the switching circuit includes a plurality of normally open switches, each of the plurality of the normally open switches is electrically connected to the two wires via a corresponding divider resistance, and each of the divider resistances has a resistance value different from the resistance values of the other divider resistances, such each of the plurality of the normally open switches is configured to generate a different voltage grading when being pressed; and the control circuit includes a power management IC, a switch controller, and a voltage detection unit; the switch controller is electrically connected to the power management IC and the voltage detection unit and receives an operation power from the power management IC; the voltage detection unit is electrically connected to the two wires, and the voltage detection unit is configure to detect the voltage grading between the two wires and outputs a detection result to the switch controller; such that according to the detection result the switch controller determines that which one of the normally open switches is pressed and generates a switch signal according to the voltage grading status to the power transforming circuit to modulate the driving power.

In at least one embodiment, at every sampling time point the power management IC switches a voltage of the driving power in to a sampling voltage and maintains the sampling voltage for a detecting time period, and the voltage detection unit executes at least one voltage detection within the detecting time period to determine whether a voltage between two wires is lower than the sampling voltage and output a detection result according to a variation of the voltage between two wires.

In this disclosure, the switching circuit is disposed on the power cable and separated from the power transformer. Therefore, the operation to switch the output of the power transformer is not required to perform on the power transformer, and the situation that the user is shocked by the domestic AC power socket can be prevented. Furthermore, waterproof is more easily applied on switching circuit, such as wrapping the switching circuit by a waterproofing membrane or waterproofing glue, which further reduce the possibility of electric leakage occurrence. Moreover, since the normally open switch is disposed on the power cable, the normally open switch can be disposed at anywhere on the power cable in accordance with the design requirement of the string light; so as to present more diversified string light products.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
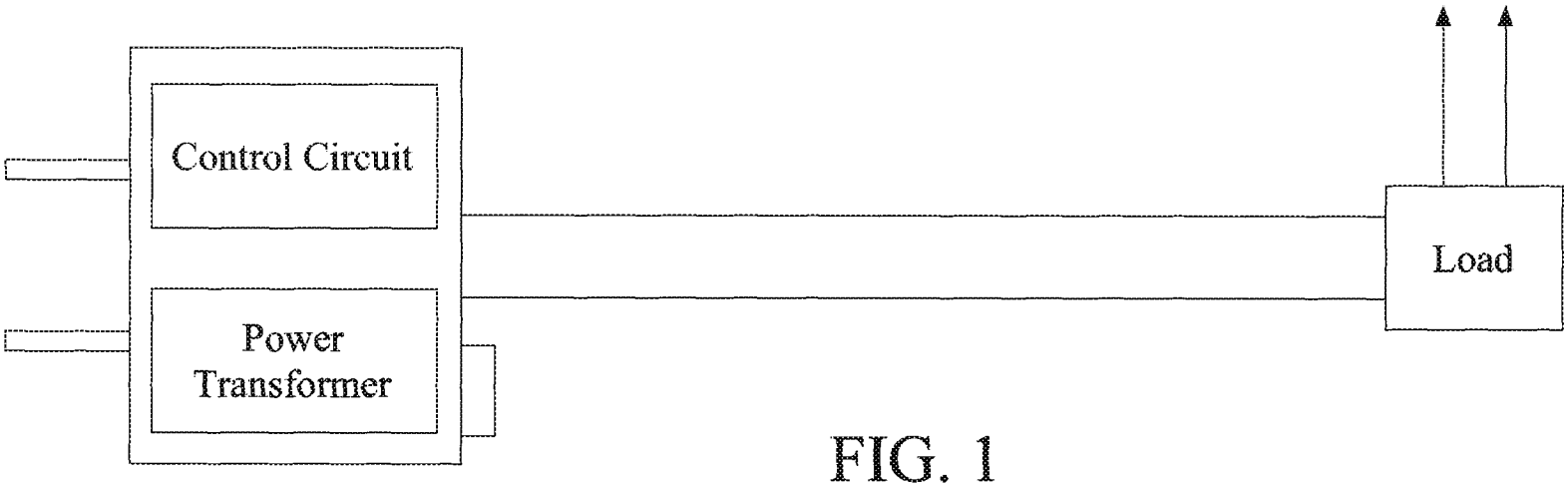
FIG. 1 (Prior ART)
FIG. 1 is a schematic view illustrating a power supply apparatus for a string light in the art.
Figure 2:
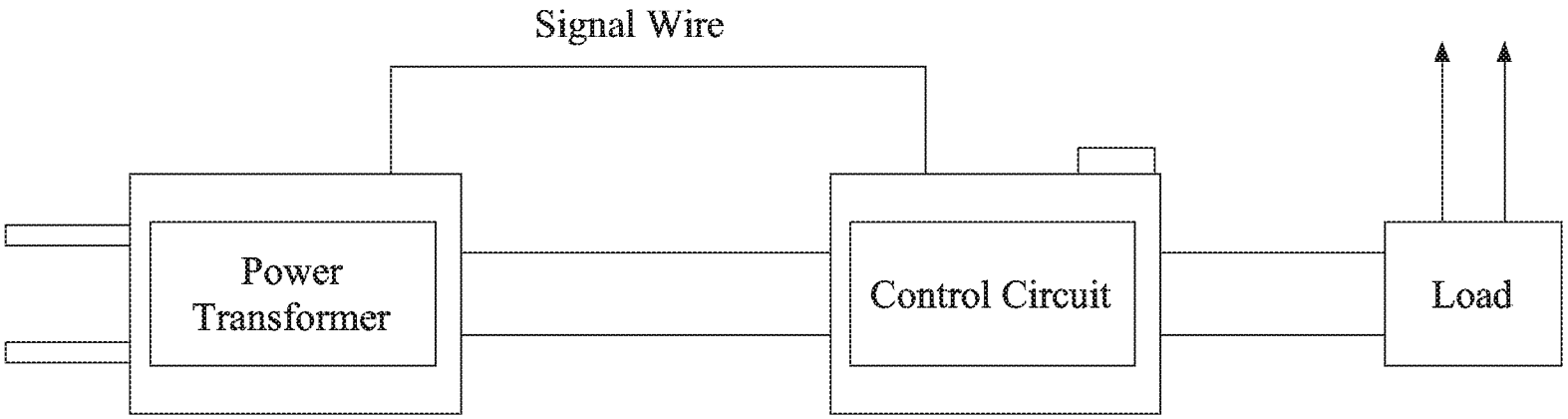
FIG. 2 (Prior Art)
FIG. 2 is a schematic view illustrating another power supply apparatus for a string light in the art.
Figure 3:
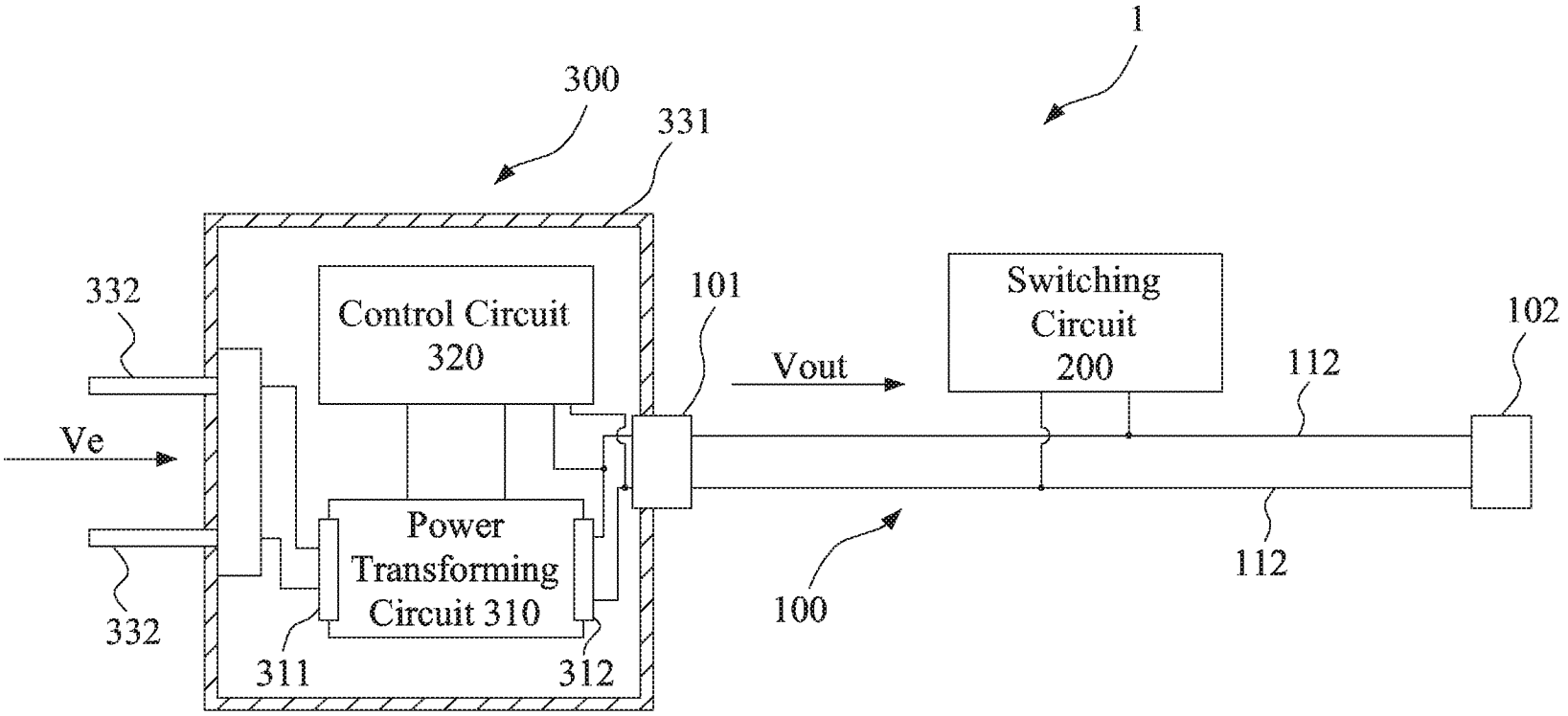
FIG. 3 is a circuit block diagram of a power supply apparatus for a string light according to a first embodiment of this disclosure.
Figure 4:
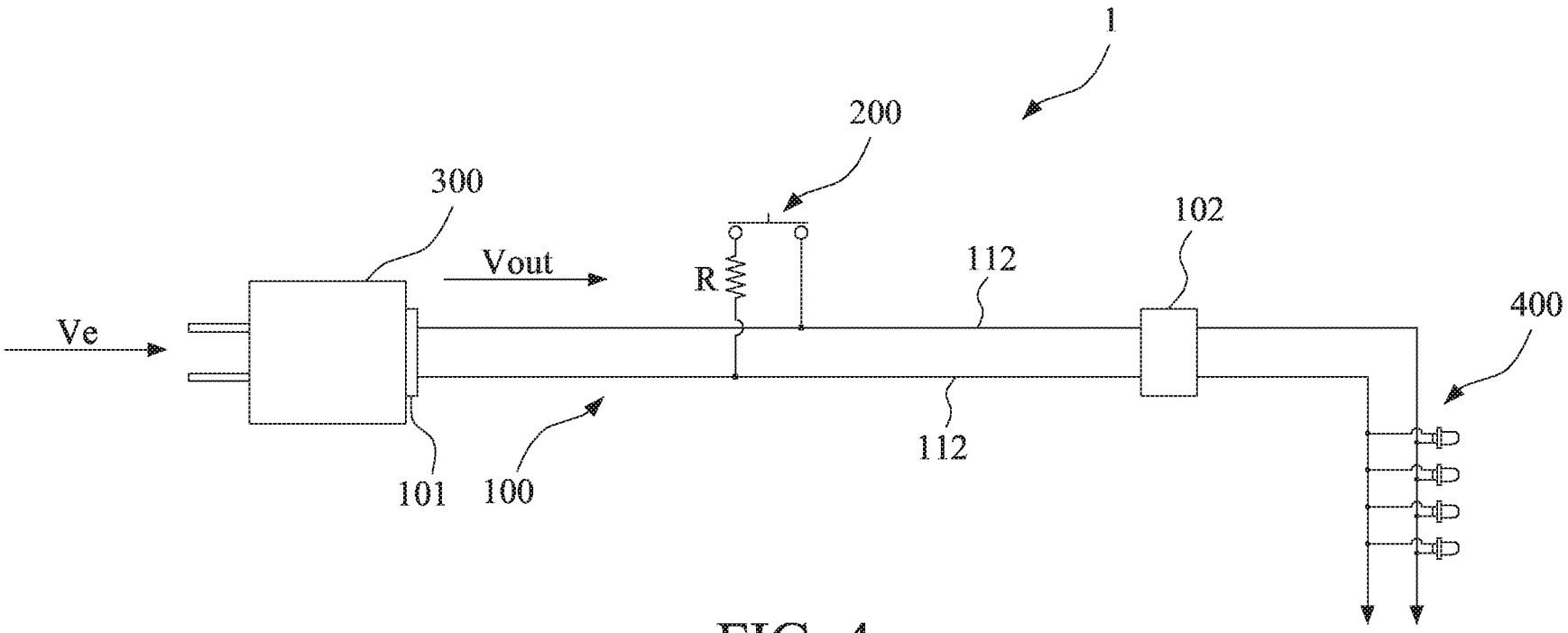
FIG. 4 is another circuit block diagram of a power supply apparatus for a string light according to the first embodiment of this disclosure.

Please refer to FIG. 3 and FIG. 4, which illustrate a power supply apparatus 1 for a string light 400 according to a first embodiment of this disclosure. The power supply apparatus 1 includes a power cable 100, a switching circuit 200, and a power transformer 300.

As shown in FIG. 3 and FIG. 4, the power cable 100 includes a receiving end 101 and a loading end 102. The power cable 100 includes at least two wires 112 respectively extending from the receiving end 101 to the loading end 102. The loading end 102 is adapted for electrically connecting to the string light 400. The loading end 102 can be directly connected to the string light 400 by welding, alternatively the loading end 102 can be connected to the string light 400 via a combination of electrical connectors. Or the two wires 112 can be sections of the string light 400 and the loading end 102 corresponding the light emitting diodes of the string light 400. The switching circuit 200 is electrically connected to the two wires 112 and configured to selectively form a voltage grading between the two wires 112.

As shown in FIG. 3 and FIG. 4, the power transformer 300 includes a power transforming circuit 310 and a control circuit 320. The power transforming circuit 310 includes an input terminal 311 and an output terminal 312. The power transforming circuit 310 receives an external power Ve via the input terminal 311, transforms the external power Ve into a driving power Vout, and the power transforming circuit 310 outputs the driving power Vout via the output terminal 312. The receiving end 101 of the power cable 100 is electrically connected to the output terminal 312, to output the driving power Vout from the loading end 102.

As shown in FIG. 3, the control circuit 320 is electrically connected to the power transforming circuit 310 and the two wires 112. The control circuit 320 detects a voltage grading status between the two wires 112, and generates a switch signal according to the voltage grading status to the power transforming circuit 310 to modulate the driving power Vout.

As shown in FIG. 3 and FIG. 4, the power transformer 300 further includes a casing 331 and two metal pins 332. The power transforming circuit 310 and the control circuit 320 are disposed within the casing 331, and the metal pins 332 protrude from a surface of the casing 331 and are electrically connected to the input terminal 311. Specifically, in one embodiment, the metal pins 332 are contact pins of an AC power plug to be inserted into a domestic AC power socket for receiving domestic AC power as the external power Ve.

In at least one embodiment the driving power Vout is a Pulse Width Modulation (PWM) signal, for driving the string light 400. The control circuit 320 is configured to control the power transforming circuit 310, to change the frequency, the duty cycle and the duty ration of the driving power Vout, so as to change the average current output from the power transforming circuit 310 to change the brightness of the string light 400.

As shown in FIG. 4, In the first embodiment, an implementation of the switching circuit 200 is a normally open switch, such as a micro switch, a capacitive switch, or a membrane switch, and a divider resistance R is provided to connect the normally open switch to one of the two wires 112 to implement control in accordance with voltage grading. As a result, when the normally open switch is pressed the normally open switch forms a voltage grading between the two wires 112.

In this disclosure, the control circuit regularly detects 320 a voltage grading status between the two wires 112, and every time a voltage grading occurs between the two wires 112 the control circuit 320 determines that one trigger signal is received. The number of times for receiving the trigger signals and the duration of each trigger signal forms a trigger signal combination in the form of a code. The control circuit 320 decodes this code and generates a corresponding switch signal to the power transforming circuit 310, to change the frequency, the duty cycle and the duty ration of the driving power Vout, so as to change the brightness or the flicker frequency of the string light 400. For example, quickly pressing and releasing the normally open switch one time to raise the brightness of the string light 400, pressing the normally open switch for a longer duration for one time to lower the brightness of the string light 400, pressing the normally open switch for a longer duration for one time and then quickly pressing and releasing the normally open switch one time to switch the string light 400 into a flickering mode, and pressing the normally open switch for a longer duration for one time to stop the flickering mode of the string light 400.

Figure 5:
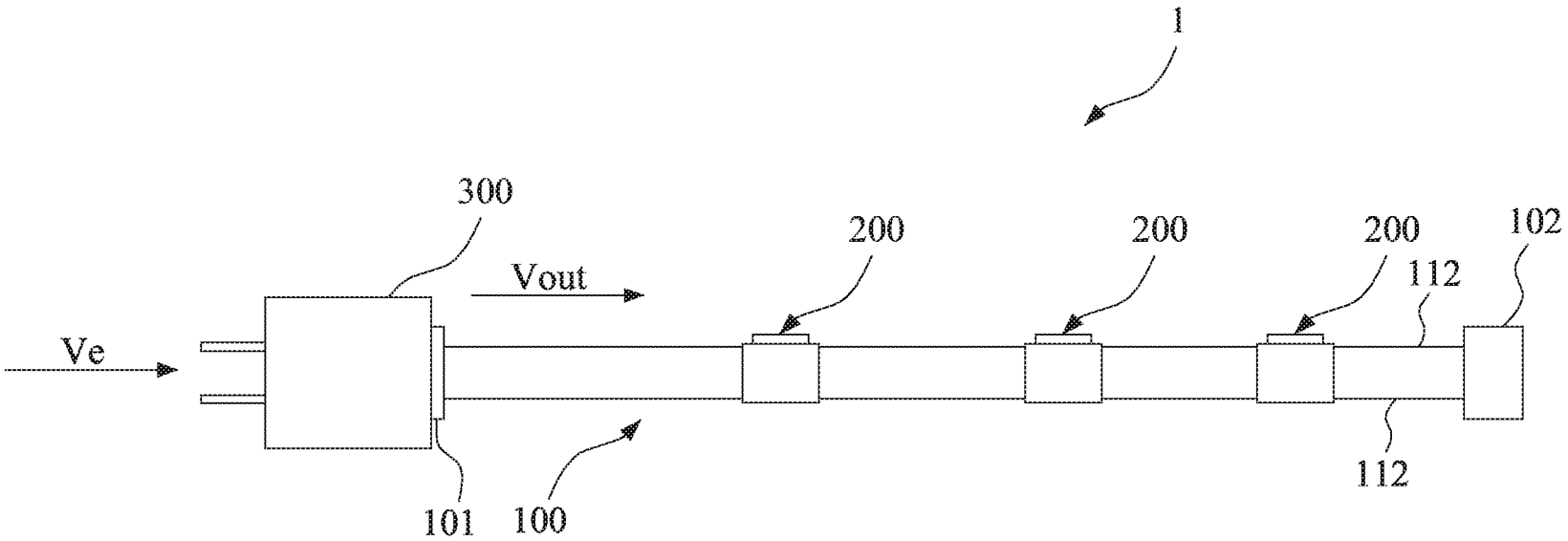
FIG. 5 is a schematic view illustrating the power supply apparatus according to the first embodiment of this disclosure.
Figure 6:
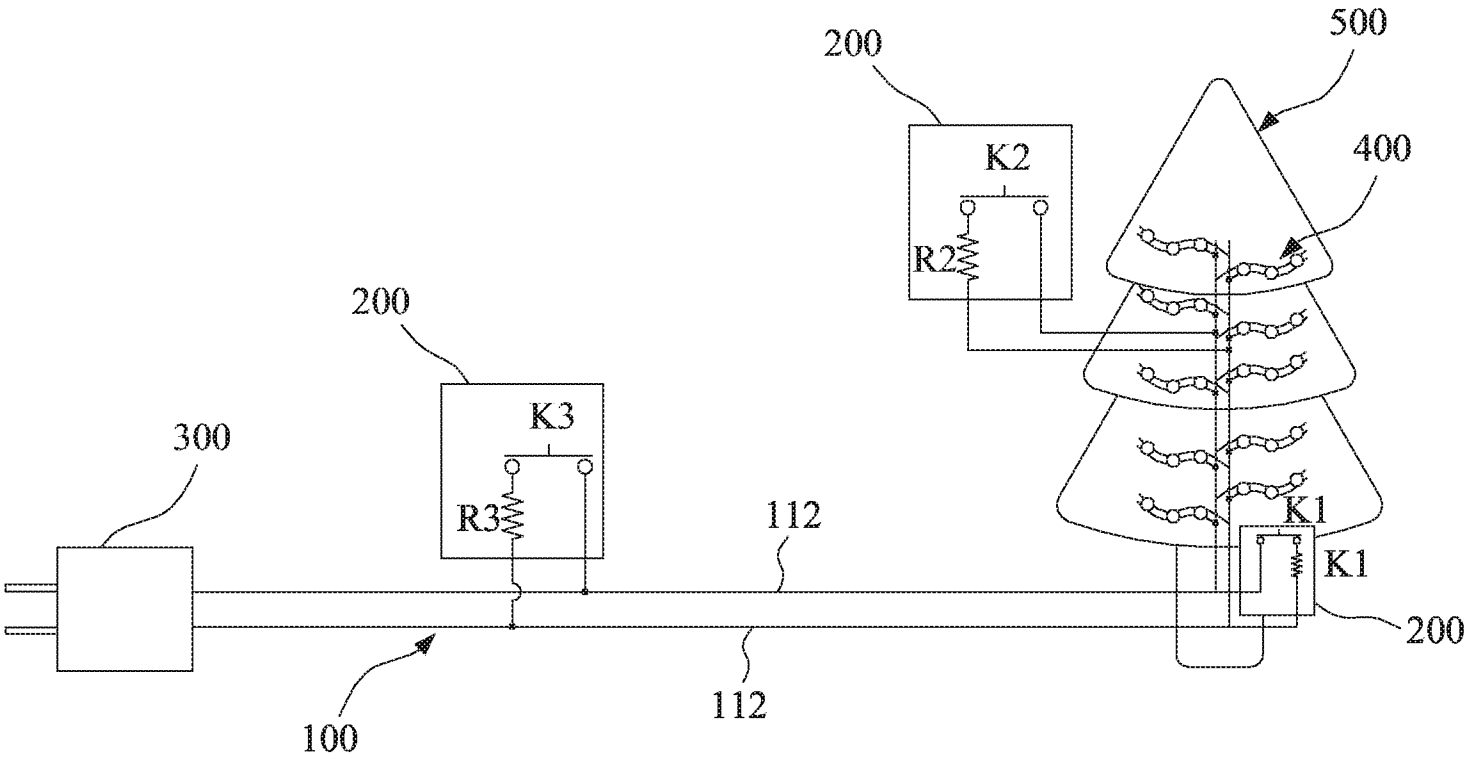
FIG. 6 is a schematic view illustrating the usage of the power supply apparatus according to the first embodiment of this disclosure.

As shown in FIGS. 5 and 6, in this disclosure, the switching circuit 200 is disposed on the power cable 100 and separated from the power transformer 300. As a result, the operation to switch the output of the power transformer 300 is not required to perform on the power transformer 300, and the situation that the user is shocked by the domestic AC power socket can be prevented. Moreover, taking the normally open switch as an illustration, a plurality of switching circuit 200 can be disposed on the power cable 100 simultaneously. For example, three normally open switches K1, K2, K3 are respectively disposed on different positions on the power cable 100. Meanwhile, the three normally open switches K1, K2, K3 are electrically connected to different divider resistances R1, R2, R3. The divider resistances R1, R2, R3 have different resistance values. Each normally open switch K1, K2, K3 is configured to be pressed to generate a corresponding voltage grading, and the control circuit 320 can determine which one of the plural normally open switches K1, K2, K3 is pressed and generate a corresponding switching signal to change the driving power Vout. Therefore, when plural normally open switches are provided, it is not required to press a single switch for plural times to generate a corresponding code. For example, in the case that pressing switch K1 to raise the brightness of the string light 400, pressing switch K2 to lower the brightness of the string light 400, and pressing switch K2 to turn on or turn off the string light 400. Moreover, According to the corresponding operation, each normally open switch K1, K2, K3 can be disposed on a different position on the power cable 100. For example, when decorating a Christmas tree by the string light 400, the normally open switches K1, K2, K3 of the switching circuit 200 can be configured on the trunk of the Christmas tree 500, hanging on the leaves of the Christmas tree 500 or the middle section of the cable 100. At this time, the user can directly switch the operation on the Christmas tree 500.

Figure 7:
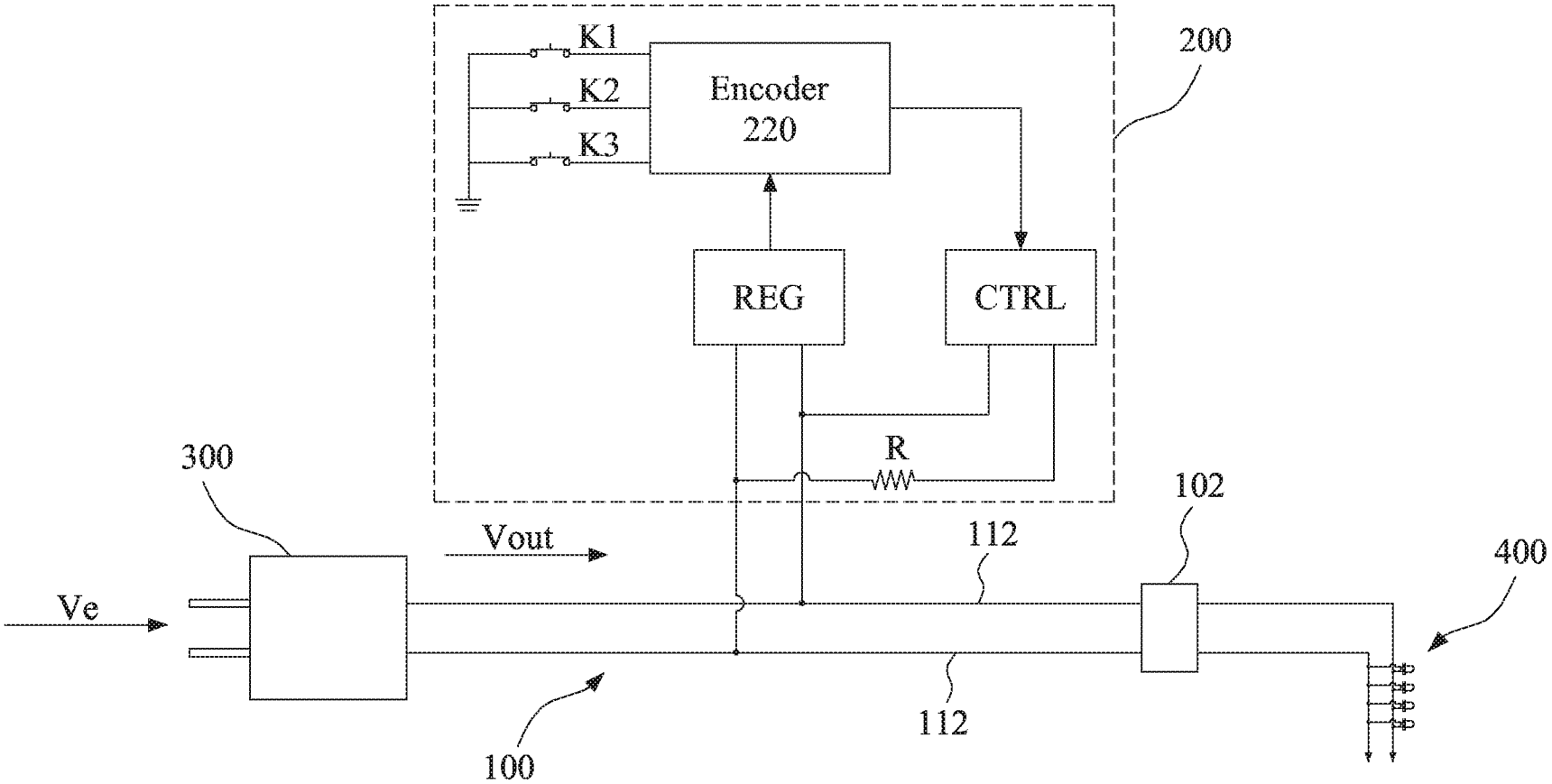
FIG. 7 is a circuit block diagram of a power supply apparatus for a string light according to a second embodiment of this disclosure.
Figure 8:
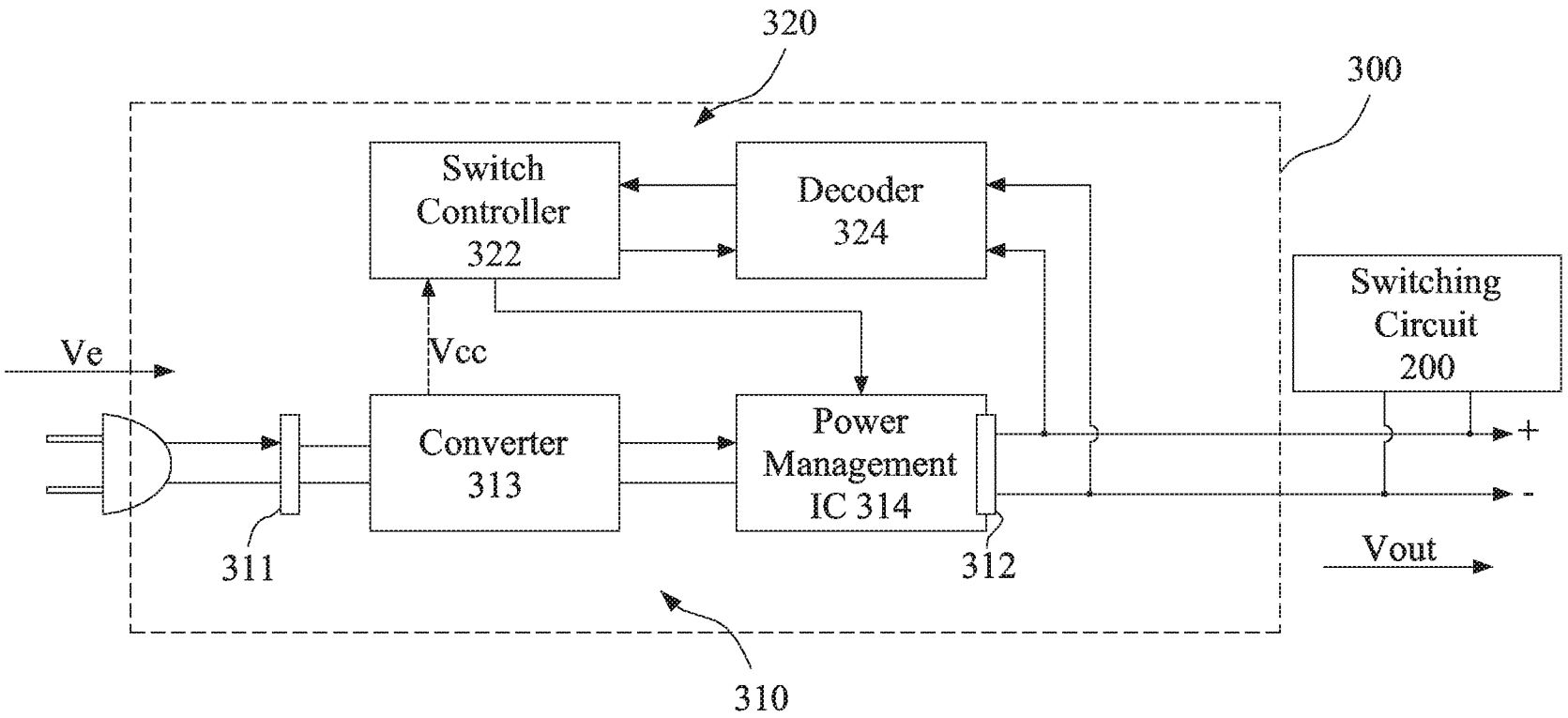
FIG. 8 is another circuit block diagram of a power supply apparatus for a string light according to the second embodiment of this disclosure.

As shown in FIG. 7 and FIG. 8, which illustrate a power supply, apparatus 1 for a string light 400 according to a second embodiment of this disclosure. The power supply apparatus 1 includes a power cable 100, a switching circuit 200, and a power transformer 300. In the first embodiment, in the switching circuit 200, the user manually presses the normally open switch to generate the trigger signal combination. In the second embodiment, the switching circuit 200 automatically generates a relatively complex trigger signal combination.

The switching circuit 200 includes an encoder 220, a voltage regulator REG, a plurality of normally open switches K1, K2, K3 and a power switch IC CTRL. The voltage regulator REG is electrically connected to the two wires 112 to obtain the driving power Vout, and the voltage regulator REG converts the driving power Vout into an operation power Vcc and outputs to the operation power Vcc to the encoder 220. The power switch IC CTRL is electrically connected to the two wires 112, the power switch IC is configured to receive the switch signal, and connects the two wires 112 via the divider resistance R according to the switching signal to form the voltage grading. A plurality of trigger signal combinations are set in the encoder 220, and each of the trigger signal combinations is provided for the encoder 220 to generate a corresponding switching signal accordingly, so as to drive the power switch IC CTRL to connects the two wires 112 via the divider resistance R according to the switching signal to form the voltage grading according to the corresponding trigger signal combination.

As shown in FIG. 7, three normally open switches K1, K2, K3 are electrically connected to the encoder 220, and are respectively configured to be pressed to generate a corresponding selection signal. Each of the normally open switches K1, K2, K3 is configured corresponding to one trigger signal combination. As a result, in response to the need to turn on, turn off or switch the string light 400, the user only needs to press a corresponding normally open switch K1, K2, K3 to drive the encoder 220 to generate the corresponding switch signal with the corresponding trigger signal combination. The power switch IC CTRL to connects the two wires 112 via the divider resistance R according to the switching signal to form the voltage grading according to the corresponding trigger signal combination. Each of the normally open switches K1, K2, K3 can be, but not limited to a micro switch, a capacitive switch, or a membrane switch; one end of each of the normally open switches K1, K2, K3 is electrically connected to the encoder 220 and the other end is electrically grounded. Each of the normally open contact switches K1, K2, K3 can change the corresponding contact of the encoder 220 from a high voltage level to a low voltage level when pressed, so as to form a selection signal to the encoder 220.

Referring to FIG. 8, the power transforming circuit 310 includes a converter 313 and a power management IC 314. The converter 313 can be a winding group or a bridge rectifier circuit. The converter 313 is arranged corresponding to the input terminal 311, for receiving domestic AC power as the external power Ve and converts the external power Ve into direct-current power. The power management IC 314 is electrically connected to the converter 313 and arranged corresponding to the output terminal 312. The power management IC 314 is used as a power switch and a buck-boost for the direct current, so as to output the driving power Vout.

Referring to FIG. 8, the control circuit 320 includes a switch controller 322 and a decoder 324. The decoder 324 is electrically connected to the two wires 112. The switch controller 322 is electrically connected to the power management IC 314 and the decoder 324, and receives the operation power Vcc for the converter 313.

The decoder 324 is configured to analyze each of the plurality of the trigger signal combinations and transmit corresponding information to the switch controller 322. According to the received trigger signal combination, the switch controller 322 loads a corresponding switch mode. According to the switch mode, the switch controller 322 generates the corresponding switching signal to the power transforming circuit 310, to change the frequency, the duty cycle and the duty ration of the driving power Vout, so as to change the brightness or the flicker frequency of the string light 400. For example, pressing switch K1 to raise the brightness of the string light 400, pressing switch K2 to switch the string light 400 into a flickering mode, and pressing switch K3 to stop the flickering mode of the string light 400. The number of normally open switches K1, K2, K3 is not limited to three, may be more than three or less than three. In the second embodiment, the operation of connecting the two wires 112 via the divider resistance R is modified to be performed by the encoder 220 driving the power switch IC CTRL. Therefore, the duration time of each detection of the voltage grading status can be greatly shortened. The human eye will not be able to recognize the short extinction of the string light 400 when detecting the voltage grading status. Moreover, the power transforming circuit 310 and the switching circuit 200 in the second embodiment can also be applied to the first embodiment.

Figure 9:
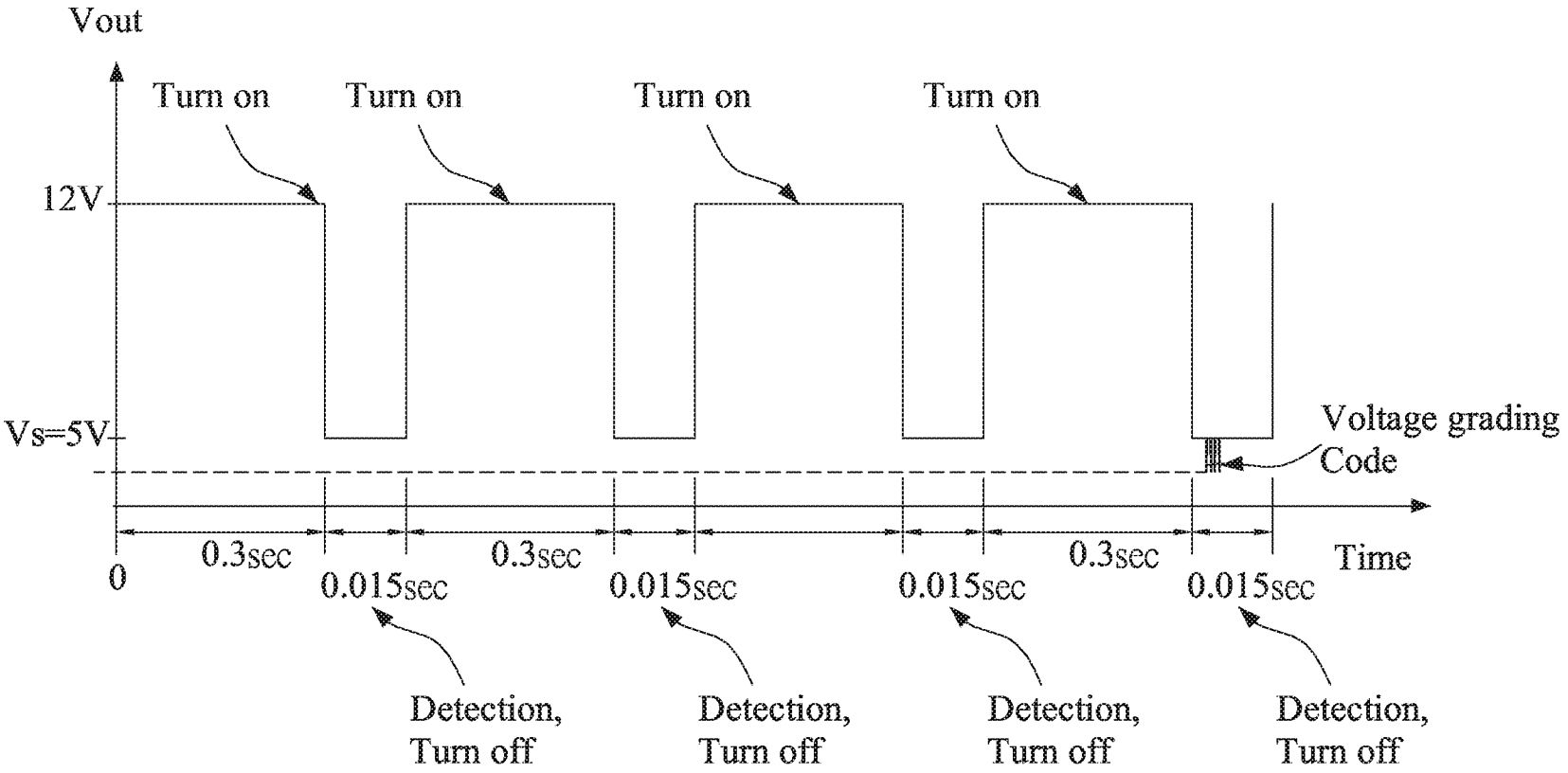
FIG. 9 and FIG. 10 illustrate timing diagrams for detect the two wires according to the second embodiment of this disclosure.

As shown in FIG. 9, the method for detecting the voltage grading status is described as follows. Provided that the driving power Vout drives the string light 400 at 12V, after being started, the switching controller 322 first controls the power management IC 314 to output the driving power Vout at 12V, so as to light on the string light 400. At every sampling time point, for example every 0.3 seconds, the power management IC 314 switches a voltage of the driving power Vout in to a sampling voltage Vs, for example a sampling voltage Vs at 5V, and maintains the sampling voltage Vs for a detecting time period, for example detecting time period of 0.015 seconds. The sampling voltage Vs is set to a voltage value that cannot drive the string light 400 to emit light, so that the string light 400 is turned off briefly. Meanwhile, the decoder 324 executes one or more detection within the detecting time period. For example, in one detecting time period of 0.01 seconds, the decoder 324 executes one detection and totally executes ten detections, so as to determine whether the voltage grading status occurs and analyze the corresponding trigger signal combination.

The sampling voltage Vs is set to a low voltage value that cannot drive the string light 400 to emit light, a low voltage value also prevents a high current from occurring when executing the detection. Although the string light 400 is turned off during a detection, the detecting time period is extremely short and the string light 400 flickers at an extremely high frequency within the detecting time period, and the human eye will not be able to recognize the short extinction of the string light 400.

Figure 10:
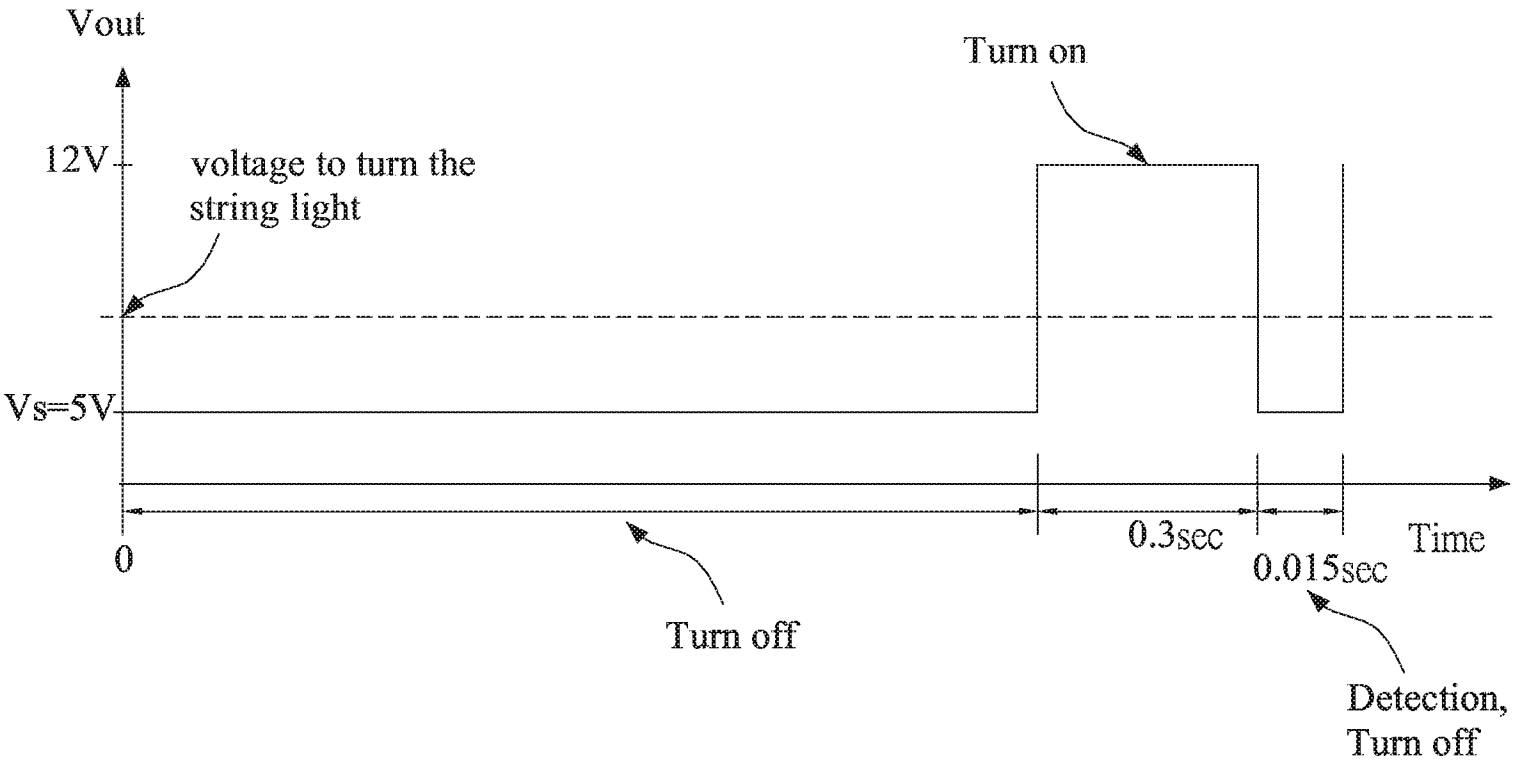

As shown in FIG. 10, one of the normally open switches K1, K2, K3 can be set as the power switch. When the string light 400 is turned on, the trigger signal combination corresponding to this power switch can be used as a turn-off signal for triggering the switch controller 322 to control the power management IC 314, so as to lower the driving power Vout to the sampling voltage Vs that is not able to light on the string light 400 and the string light 400 is turned off. At this time the power transforming circuit 310 continuously outputs the operation power Vcc to the control circuit 320, and the decoder 324 continuously detects a voltage grading status between the two wires 112. When the trigger signal combination corresponding to the power switch occurs again, the switch controller determines this trigger signal combination as a turn-on signal and controls the power management IC 314 to output the driving power Vout at 12V.

Figure 11:
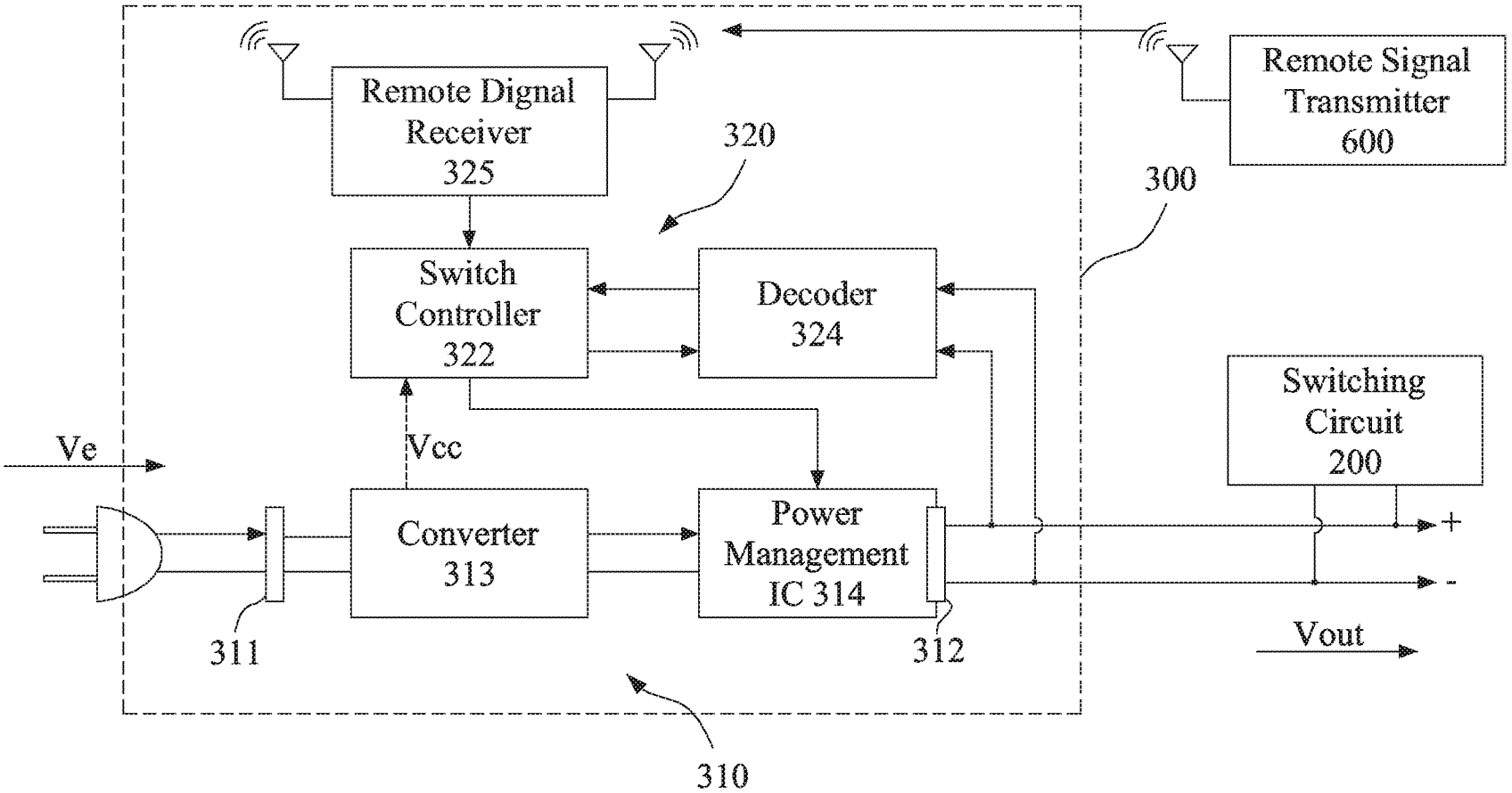
FIG. 11 is a circuit block diagram of a power supply apparatus for a string light according to a third embodiment of this disclosure.

Referring to FIG. 11, a power transformer 300 according to a third embodiment of this disclosure is illustrated, which is provided to replace the power transformer in the above-mentioned embodiment. In third embodiment, the control circuit 320 further includes a remote signal receiver 325, electrically connected to the switch controller 322. The remote signal receiver 325 is configured to receive a plurality of remote selection signals from a remote signal transmitter 600 and transfer the remote selection signals to the switch controller 322. Each of the remote selection signals corresponds to a switch mode, and the switch controller 322 generates the corresponding switching signal to the power transforming circuit 310 according to a selected switch mode, to change the frequency, the duty cycle and the duty ration of the driving power Vout, so as to change the brightness or the flicker frequency of the string light 400.

Figure 12:
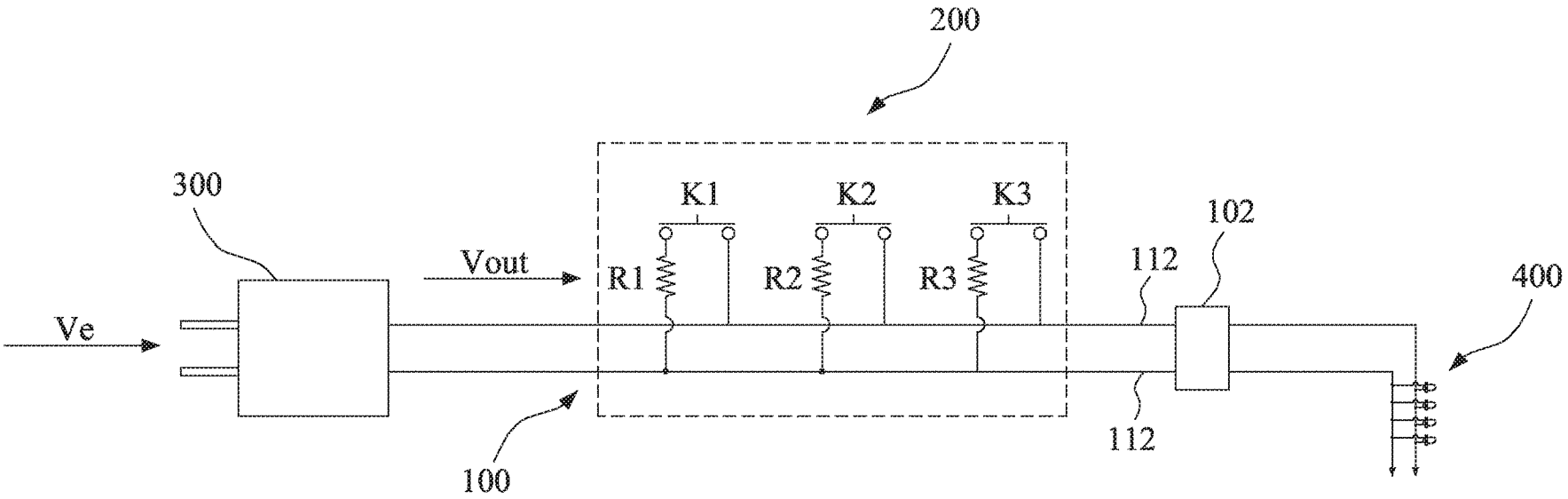
FIG. 12 is a circuit block diagram of a power supply apparatus for a string light according to a fourth embodiment of this disclosure.
Figure 13:
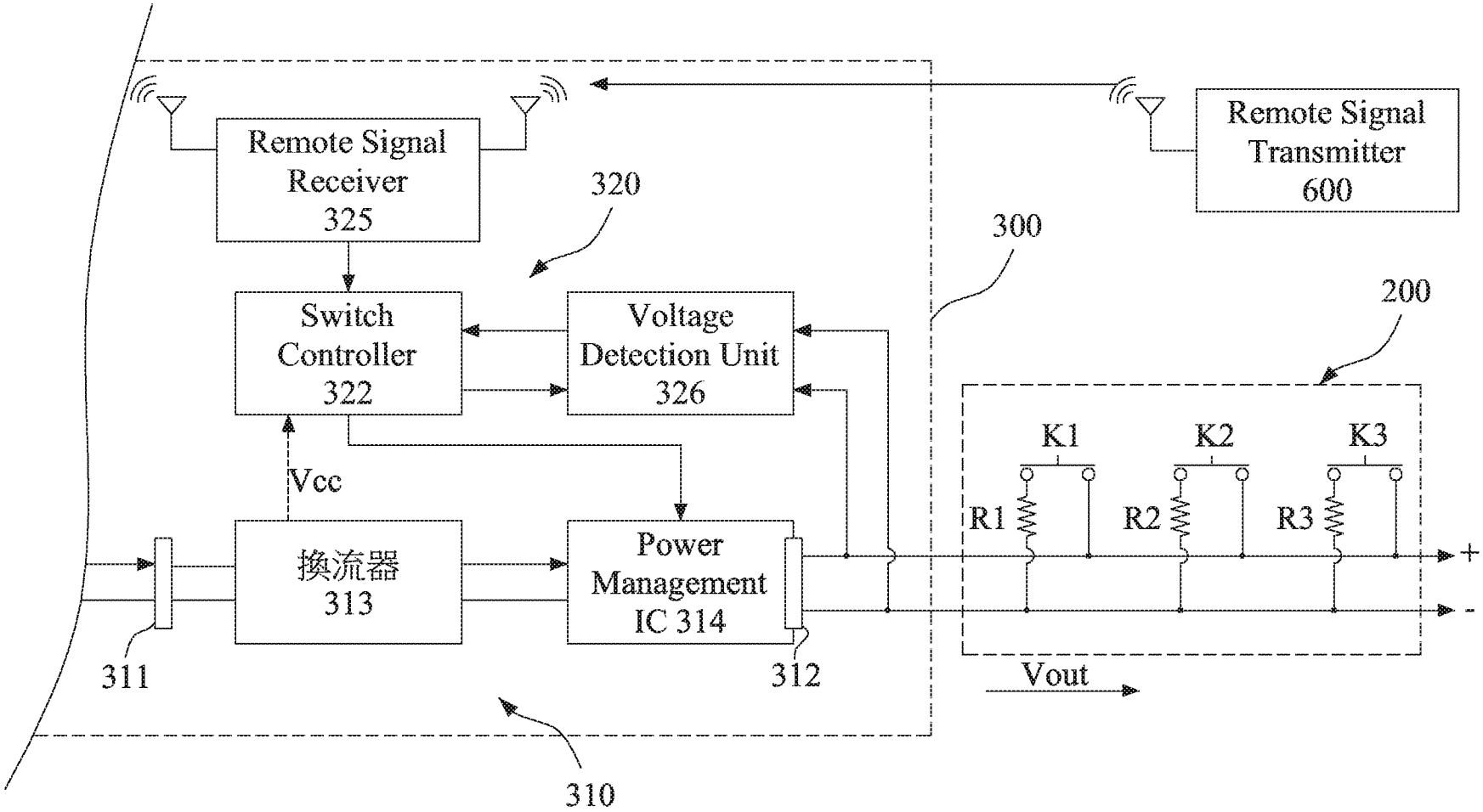
FIG. 13 is another circuit block diagram of a power supply apparatus for a string light according to the fourth embodiment of this disclosure.

As shown in FIG. 12 and FIG. 13, which illustrate a power supply apparatus 1 for a string light 400 according to a fourth embodiment of this disclosure. The power supply apparatus 1 includes a power cable 100, a switching circuit 200, and a power transformer 300.

As shown in FIG. 12, in the fourth embodiment, the switching circuit 200 is simplified and composed of a plurality of normally open switches K1, K2, K3. Each of the normally open switches K1, K2, K3 is electrically to the two wires 112 via a corresponding divider resistance R1, R2, R3. Each of the divider resistances R1, R2, R3 has a resistance value different from the resistance values of the other divider resistances, each normally open switch K1, K2, K3 is configured to be pressed to generate a corresponding voltage grading, As shown in FIG. 13, the control circuit 320 of this embodiment is similar to that of the second of third embodiment, one of the differences is that, the decoder 324 is replaced by a voltage detection unit 326. The voltage detection unit 326 is electrically connected to the two wires 112. The switch controller 322 is electrically connected to the power management IC 314 and the voltage detection unit 326, and receives the operation power Vcc for the converter 313.

Figure 14:
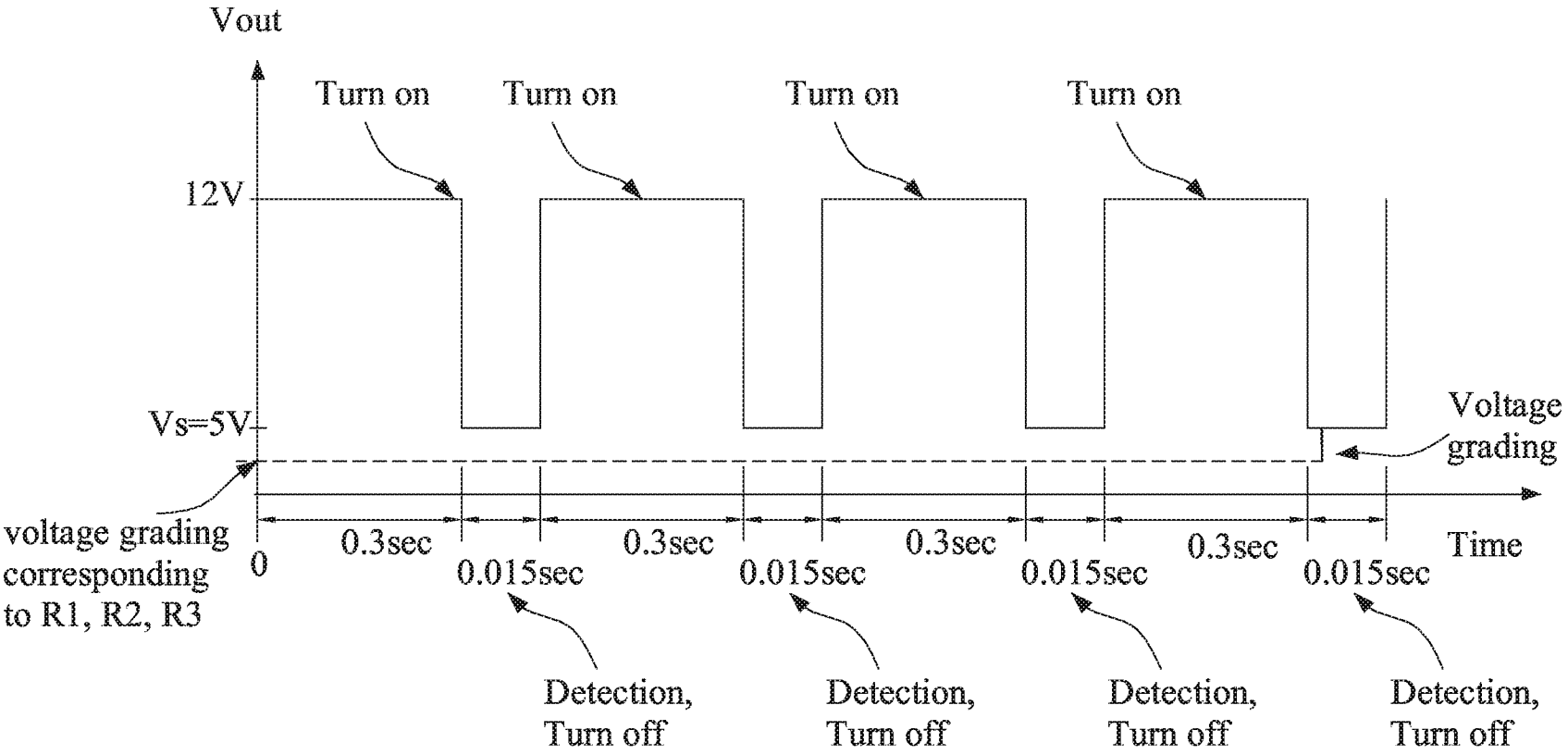
FIG. 14 illustrates a timing diagram for detect the two wires according to the fourth embodiment of this disclosure.

As shown in FIG. 13 and FIG. 14, the three normally open switches K1, K2, K3 are electrically connected to different divider resistances R1, R2, R3. And each normally open switch K1, K2, K3 is configured to be pressed to generate a corresponding voltage grading. The voltage detection unit 326 is configured to detect the voltage grading and transmit corresponding information to the switch controller 322. According to the voltage grading detection result, the switch controller 322 determines which one of the normally open switches K1, K2, K3 is pressed and loads the corresponding switch mode. The voltage detection unit 326 can be a comparator, configured to compare the range in which the voltage difference between the two wires 112 falls, and outputs a corresponding detection result to the switch controller 322, and the switch controller 322 determines which one of the normally open switches K1, K2, K3 is pressed according to the detection result. Or the voltage detection unit 326 can be an analog-digital conversion device, configured to transform the voltage value into a digital signal and transfer the digital signal to the switch controller 322. According to the digital signal, the switch controller 322 determines which one of the normally open switches K1, K2, K3 is pressed.

According to the switch mode, the switch controller 322 generates the corresponding switching signal to the power transforming circuit 310, to change the frequency, the duty cycle and the duty ration of the driving power Vout, so as to change the brightness or the flicker frequency of the string light 400. As a result, through the normally open switches K1, K2, K3 being electrically connected to different divider resistances R1, R2, R3. The control circuit 320 is able to distinguish different normally open switches K1, K2, K3.

Referring to FIG. 14, the method for detecting the voltage grading status is described as follows. Provided that the driving power Vout drives the string light 400 at 12V, after being started, the switching controller 322 first controls the power management IC 314 to output the driving power Vout at 12V to turn on the string light 400. At every sampling time point, for example every 0.3 seconds, the power management IC 314 switches a voltage of the driving power Vout in to a sampling voltage Vs, for example a sampling voltage Vs at 5V, to turn off the string light 400, and maintains the sampling voltage for a detecting time period, for example detecting time period of 0.015 seconds. At this time, and the voltage detection unit 326 executes at least one voltage detection within the detecting time period. For example, in one detecting time period of 0.01 seconds, the voltage detection unit 326 executes one voltage detection and totally executes ten voltage detections, to determine whether a voltage between two wires is lower than the sampling voltage Vs and output a detection result according to a variation of the voltage between two wires 112. For example, in the case that by pressing switch K1 the divider resistance R1 lower the voltage between the two wire 112 from 5V to 2.5V, and by pressing switch K2 the divider resistance R2 lower the voltage between the two wire 112 from 5V to 3.5V. When a voltage of 2.5V is detected, the detection result corresponds to normally open switch K1. When a voltage of 3.5V is detected, the detection result corresponds to normally open switch K2. Similarly, the detecting time period is extremely short and the string light 400 flickers at an extremely high frequency within the detecting time period, and the human eye will not be able to recognize the short extinction of the string light 400.

Similarly, as shown in FIG. 10, one of the normally open switches K1, K2, K3 can be set as the power switch. When the string light 400 is turned off, the driving power Vout is lowered down to the sampling voltage Vs that is not able to light on the string light 400. At this time the power transforming circuit 310 continuously outputs the operation power Vcc to the control circuit 320, and the voltage detection unit 326 and switch controller continuously detect a voltage grading status between the two wires 112. When the voltage grading corresponding to the power switch occurs again, the switch controller determines this voltage grading as a turn-on signal and controls the power management IC 314 to output the driving power Vout at 12V.

In this disclosure, the switching circuit 200 is disposed on the power cable 100 and separated from the power transformer 300. As a result, the operation to switch the output of the power transformer 300 is not required to perform on the power transformer 300, and the situation that the user is shocked by the domestic AC power socket can be prevented. Meanwhile, waterproof is more easily applied on switching circuit 200, such as wrapping the switching circuit by a waterproofing membrane or waterproofing glue, which further reduce the possibility of electric leakage occurrence. Moreover, since the normally open switch K1, K2, K3 is disposed on the power cable 100, the normally open switch K1, K2, K3 can be disposed at anywhere on the power cable 100 in accordance with the design requirement of the string light 400, so as to present more diversified string light products.

What is claimed is:

1. A power supply apparatus for a string light comprising:

a power cable including a receiving end and a loading end; wherein the power cable further includes at least two wires respectively extending from the receiving end to the loading end; wherein the loading end is configured to be electrically connected to the string light;

a switching circuit disposed on the power cable and electrically connected to the two wires and configured to selectively form a voltage grading between the two wires; wherein the switching circuit include an encoder, a plurality of normally open switches, a power switch IC, and a divider resistance; the plurality of normally open switches are electrically connected to the encoder and are configured to be pressed to generate a selection signal, each of the plurality of normally open switches respectively corresponds to each of a plurality trigger signal combination, and each of the plurality of normally open switches is configured to trigger the encoder to generate the switching signal according to the corresponding trigger signal combination, so as to drive the power switch IC to connect the two wires via the divider resistance to form the voltage grading according to the corresponding trigger signal combination; and a power transformer including:

a power transforming circuit including an input terminal and an output terminal; wherein the power transforming circuit receives an external power via the input terminal, transforms the external power into a driving power;

a control circuit, electrically connected to the power transforming circuit and the two wires; wherein the control circuit is configured to detect a voltage grading status between the two wires and generating a switch signal according to the voltage grading status to the power transforming circuit to modulate the driving power, the driving power is a Pulse Width Modulation (PWM) signal, and the switch signal is configured to modulate a duty ratio of the PWM signal; wherein the control circuit includes a power management IC, a switch controller and a decoder the switch controller is electrically connected to the power management IC and the decoder and receives an operation power from the power management IC; the decoder is electrically connected to the two wires, and the decoder is configured to analyze each of the plurality of the trigger signal combinations and transmit corresponding information to the switch controller, such that the switch controller generates a switch signal to the power transforming circuit according to the corresponding trigger signal combination to modulate the driving power; and a casing, wherein the power transforming circuit and the control circuit are disposed within the casing, and the power cable is disposed outside the casing with the receiving end connected to the casing and the receiving end of the power cable is electrically connected to the output terminal to receive the driving power for driving the string light.

2. The power supply apparatus as claimed in claim 1, wherein the power transformer further includes two metal pins and the metal pins protrude from a surface of the casing and are electrically connected to the input terminal.

3. The power supply apparatus as claimed in claim 1, wherein the control circuit further includes a remote signal receiver electrically connected to the switch controller; wherein the remote signal receiver is configured to receive a plurality of remote selection signals and transmit to the switch controller; each of the remote selection signals corresponds to a switch mode such that the switch controller generates the switch signal according to the corresponding switch mode to drive the power transforming circuit to modulate the driving power.

4. The power supply apparatus as claimed in claim 1, wherein the power transforming circuit further includes a converter arranged corresponding to the input terminal, the converter is configured to transform the external power into a direct-current power, and the power management IC is electrically connected to the converter, to change a voltage level of the direct-current power to form the driving power.

5. The power supply apparatus as claimed in claim 1, wherein at every sampling time point the power management IC switches a voltage of the driving power in to a sampling voltage and maintains the sampling voltage for a detecting time period, and the decoder executes at least one detection within the detecting time period to determine whether the voltage grading status occurs and analyze the corresponding trigger signal combination.

6. A power supply apparatus for a string light comprising:

a power cable including a receiving end and a loading end; wherein the power cable further includes at least two wires respectively extending from the receiving end to the loading end; wherein the loading end is configured to be electrically connected to the string light;

a switching circuit disposed on the power cable and electrically connected to the two wires and configured to selectively form a voltage grading between the two wires; wherein the switching circuit includes a plurality of normally open switches, each of the plurality of the normally open switches is electrically connected to the two wires via a corresponding divider resistance, and each of the divider resistances has a resistance value different from the resistance values of the other divider resistances, such each of the plurality of the normally open switches is configured to generate a different voltage grading when being pressed; and a power transformer including:

a power transforming circuit including an input terminal and an output terminal; wherein the power transforming circuit receives an external power via the input terminal, transforms the external power into a driving power;

a control circuit, electrically connected to the power transforming circuit and the two wires; wherein the control circuit is configured to detect a voltage grading status between the two wires and generating a switch signal according to the voltage grading status to the power transforming circuit to modulate the driving power, the driving power is a Pulse Width Modulation (PWM) signal, and the switch signal is configured to modulate a duty ratio of the PWM signal; wherein the control circuit includes a power management IC, a switch controller, and a voltage detection unit; the switch controller is electrically connected to the power management IC and the voltage detection unit and receives an operation power from the power management IC; the voltage detection unit is electrically connected to the two wires, and the voltage detection unit is configure to detect the voltage grading between the two wires and outputs a detection result to the switch controller; such that according to the detection result the switch controller determines that which one of the normally open switches is pressed and generates a corresponding switch signal to the power transforming circuit to modulate the driving power; and a casing, wherein the power transforming circuit and the control circuit are disposed within the casing, and the power cable is disposed outside the casing with the receiving end connected to the casing and the receiving end of the power cable is electrically connected to the output terminal to receive the driving power for driving the string light.

7. The power supply apparatus as claimed in claim 6, wherein at every sampling time point the power management IC switches a voltage of the driving power in to a sampling voltage and maintains the sampling voltage for a detecting time period, and the voltage detection unit executes at least one voltage detection within the detecting time period to determine whether a voltage between two wires is lower than the sampling voltage and output a detection result according to a variation of the voltage between two wires.

8. The power supply apparatus as claimed in claim 6, wherein the power transformer further includes two metal pins and the metal pins protrude from a surface of the casing and are electrically connected to the input terminal.

* * * * *